US005476762A

United States Patent [19]

Marui

[11] Patent Number: 5,476,762

[45] Date of Patent: Dec. 19, 1995

[54] SILVER HALIDE PHOTOGRAPHIC LIGHT-SENSITIVE MATERIAL

[75] Inventor: Toshiyuki Marui, Hino, Japan

[73] Assignee: Konica Corporation, Japan

[21] Appl. No.: 354,665

[22] Filed: Dec. 13, 1994

[30] Foreign Application Priority Data

Dec. 21, 1993 [JP] Japan ..... 5-322479

[51] Int. Cl.[6] ..... G03C 1/93

[52] U.S. Cl. ..... 430/627; 430/631; 430/634

[58] Field of Search ..... 430/545, 546, 430/627, 631, 634

[56] References Cited

U.S. PATENT DOCUMENTS

| | | | |
|---|---|---|---|
| 4,755,448 | 7/1988 | Katoh | 430/266 |
| 4,849,359 | 7/1989 | Inoue et al. | 430/446 |
| 4,917,994 | 4/1990 | Martinez et al. | 430/463 |
| 4,935,338 | 6/1990 | Masuda et al. | 430/627 |
| 5,026,631 | 6/1991 | Yoneyama | 430/546 |
| 5,200,303 | 4/1993 | Takahashi et al. | 430/545 |
| 5,217,857 | 6/1993 | Hayashi | 430/605 |
| 5,336,592 | 8/1994 | Chino et al. | 430/603 |
| 5,370,983 | 12/1994 | Shono et al. | 430/546 |

*Primary Examiner*—Lee C. Wright

*Attorney, Agent, or Firm*—Jordan B. Bierman; Bierman and Muserlian

[57] ABSTRACT

A silver halide photographic light-sensitive material comprises a support and provided thereon, a photographic component layer comprising a silver halide emulsion layer, the material being processed in 10 seconds to less than 45 seconds, wherein the photographic component layer comprises polymer latex of a polymer containing in its chemical structure a unit derived from a monomer having a solubility in water of 25° C. of 0.000 to 0.025% by weight and the pH of the surface on the silver halide emulsion layer side of the material is not more than 6.0.

11 Claims, No Drawings

SILVER HALIDE PHOTOGRAPHIC LIGHT-SENSITIVE MATERIAL

FIELD OF THE INVENTION

The present invention relates to a silver halide photographic light-sensitive material, more practically to a silver halide photographic light-sensitive material that is free from the occurrence of development unevenness and a roller mark (pressure fogging or pressure desensitization) which occur in rapid processing in an automatic processor.

BACKGROUND OF THE INVENTION

Recently, with the progress of photographic technologies, high sensitivity and high image quality of a silver halide photographic light-sensitive material are strongly demanded. In addition, with an increased consumption of light-sensitive materials, rapid processing such as that of less than 45 seconds has been strongly demanded.

In order to realize rapid processing, developability must be enhanced and a burden for drying must be lightened. For example, when developability is enhanced by processing at a high pH and at a high temperature (30° to 40° C.) or an amount of a binder in a light-sensitive material is reduced, rapid processing is attained. However, in such cases, so-called roller marks have occurred due to the pressure by a conveyance roller, resulting in deterioration of image quality, and an increase of contrast or fog.

As a means for overcoming the roller marks, use of polymer latex is known. However, this technology has such a problem that the specific surface resistance of a light-sensitive material increases resulting in inducing static electricity, or development unevenness or color stains occur.

SUMMARY OF THE INVENTION

Accordingly, an object of the present invention is to provide a silver halide photographic light-sensitive material having high sensitivity and high image quality wherein development unevenness and roller marks (pressure fogging or pressure desensitization) which occur in rapid processing in an automatic processor are prevented and static marks and color stains are not caused.

DETAILED DESCRIPTION OF THE INVENTION

The above object of the invention can be attained by a silver halide photographic light-sensitive material comprising a support and a silver halide emulsion layer provided thereon, the material being processed in less than 45 seconds, wherein the material comprises polymer latex of a polymer containing in its chemical structure a unit derived from a monomer having a solubility in water of 25° C. of 0.000 to 0.025% by weight and the pH of the surface on the silver halide emulsion layer side of the material is not more than 6.0.

The polymer latex of the invention is preferably obtained by polymerizing a monomer in the presence of a water soluble polymer and/or a surfactant.

At least one of monomers used to form the polymer latex of the invention has a solubility in water at 25° C. of 0.000 to 0.025% by weight, and preferably 0.000 to 0.015% by weight. Examples of the monomers include acrylates such as hexyl acrylate, 2-ethylhexyl acrylate, octyl acrylate, tert-octyl acrylate, nonyl acrylate, iso-nonyl acrylate, cyclohexyl acrylate, n-stearyl acrylate, lauryl acrylate and tridecyl acrylate; methacrylates such as hexyl methacrylate, 2-ethylhexyl methacrylate, octyl methacrylate, iso-octyl methacrylate, tert-octyl methacrylate, nonyl methacrylate, iso-nonyl methacrylate, cyclohexyl methacrylate, n-stearyl methacrylate, lauryl methacrylate and tridecyl methacrylate and divinylbenzene.

The solubility in water at 25° C. of the above monomers can be measured according to a method described in the "Shin Jikken Kagaku Koza, Kihon Sosa 1", p.223–250 (New Experimental Chemistry Course: Basic Operations 1) (Maruzene Kagaku, 1975). When measured according to this method, the solubility in water at 25° C. of, e.g., 2-ethylhexyl acrylate is 0.010% by weight, 2-ethylhexyl methacrylate 0.005% by weight, cyclohexyl methacrylate 0.000% by weight, whereas in the case of comparative monomers, styrene 0.030% by weight, butyl acrylate 0.320% by weight and butyl methacrylate 0.030% by weight.

For obtaining the polymer latex used in the invention copolymerization of the above monomer of the invention with different other monomer compounds may be carried out. Examples of the copolymerizable monomer compounds with the above monomer of the invention include acrylates, methacrylates, vinyl esters, olefins, styrenes, crotonic acid esters, itaconic acid diesters, maleic acid diesters, fumaric acid diesters, acrylamides, allyl compounds, vinyl ethers, vinyl ketones, vinyl heterocyclic compounds, glycidyl esters, unsaturated nitriles, polyfunctional monomers, and various unsaturated acids. From the above compounds one or two or more are selected to be used in combination as monomers for copolymerization.

These copolymerizable monomer compounds will be shown below. Examples of the acrylates include methyl acrylate, isopropyl acrylate, iso-butyl acrylate, tert-butyl acrylate, amyl acrylate, 2-bromoethyl acrylate, 4-chlorobutyl acrylate, cyanoethyl acrylate, 2-acetoxyethyl acrylate, dimethylaminoethyl acrylate, methoxybenzyl acrylate, furfuryl acrylate, tetrahydrofurfuryl acrylate, phenyl acrylate, 2-hydroxyethyl acrylate, 5-hydroxypentyl acrylate, 2,2'-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, ω-methoxypolyethylene-glycol acrylate (addition molar number n=9), 1-bromo-2-methoxyethyl acrylate and 1,1-dichloro-2-ethoxyethyl acrylate.

Examples of the methacrylates include methyl methacrylate, isopropyl methacrylate, amyl methacrylate, chlorobenzyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (addition molar number n=6), allyl methacrylate and dimethylaminoethylmethyl methacrylate hyrochloric acid salt.

Examples of the vinyl esters include vinyl acetate, vinyl propionate, vinyl butyrate, vinyl isobutyrate, vinyl caproate, vinyl chloroacetate, vinylmethoxy acetate, vinylphenyl acetate, vinyl benzoate and vinyl salicylate.

Examples of the olefins include dicyclopentadiene, ethylene, propylene, 1-butene, 1-pentene, vinyl chloride, vinylidene chloride, isoprene, chloroprene, butadiene and 2,3-dimethylbutadiene.

Examples of the styrenes include styrene, methylstyrene, ethylstyrene, chloromethylstyrene, methoxystyrene, acetoxystyrene, chlorostyrene, bromostyrene, trifluorostyrene and vinylmethyl benzoate.

Examples of the crotonic acid esters include butyl crotonate.

Examples of the itaconic acid diesters include dimethyl itaconate, diethyl itaconate and dibutyl itaconate.

Examples of the maleic acid diesters include diethyl maleate, dimethyl maleate and dibutyl maleate.

Examples of the fumaric acid diesters include diethyl fumarate, dimethyl fumarate and dibutyl fumarate.

Examples of the acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide and N-(2-acetacetoxyethyl)acrylamide.

Examples of the methacrylamides include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetacetoxyethyl)methacrylamide.

Examples of the allyl compounds include allyl acetate, allyl caproate, allyl laurate and allyl benzoate.

Examples of the vinyl ethers include methylvinyl ether, butylvinyl ether, hexylvinyl ether, methoxyethylvinyl ether and dimethylaminoethylvinyl ether.

Examples of the vinyl ketones include methylvinyl ketone, phenylvinyl ketone and methoxyethylvinyl ketone.

Examples of the vinylheterocyclic compound include vinylpyridine, N-vinylimidazole, N-vinyloxazolidone, N-vinyltriazole and N-vinylpyrrolidone.

Examples of the glycidyl esters include glycidyl acrylate and glycidyl methacrylate.

Examples of the unsaturated nitriles include acrylonitrile and methacrylonitrile.

Those of the polyfunctional monomers include divinylbenzene, methylenebisacrylamide and ethyleneglycol dimethacrylate.

Further, examples of the unsaturated acid include acrylic acid, methacrylic acid, itaconic acid, maleic acid; monoalkyl itaconates such as monomethyl itaconate, monoethyl itaconate and monobutyl itaconate; monoalkyl maleates such as monomethyl maleate, monoethyl maleate and monobutyl maleate; citraconic acid, styrenesulfonic acid, vinylbenzylsulfonic acid, vinylsulfonic acid; acryloyloxyalkylsulonic acids such as acryloyloxyethylsulfonic acid and acryloyloxypropylsulfonic acid; methacryloyloxyalkylsulfonic acids such as methacryloyloxydimethylsulfonic acid, methacryloyloxyethylsulfonic acid and methacryloyloxypropylsulfonic acid; acrylamidoalkylsulfonic acids such as 2-acrylamido-2-methylethanesulfonic acid, 2-acrylamido-2-methylpropanesulfonic acid and 2-acrylamido-2-methylbutanesulfonic acid; methacrylamidoalkylsulfonic acids such as 2-methacrylamido-2-methylethanesulfonic acid, 2-methacrylamido-2-methylpropanesulfonic acid and 2-methacrylamido-2-methylbutanesulfonic acid; acryloyloxyalkyl phosphates such as acryloyloxyethyl phosphate and 3-acryloyloxypropyl-2-phosphate; methacryloyloxyalkyl phosphates such as methacryloyloxyethyl phosphate and 3-methacryloyloxypropyl-2-phosphate; and naphthyl 3-allyloxy-2-hydroxypropanesulfonate having two hydrophilic groups. These acids may be used in the form of salts of alkali metals such as Na, K or of ammonium ions. As still further monomer compounds there may be used those crosslinkable monomers as described in U.S. Pat. Nos. 3,459,790, 3,438,708, 3,554,987, 4,215,195 and 4,247,673, and JP O.P.I. No. 205735/1982. Examples of the crosslinkable monomer include N-(2-acetacetoxyethyl)acrylamide and N-{2-(2-acetacetoxyethoxy)ethyl}acrylamide.

Of the above monomers compounds are preferably used acrylic acid esters, methacrylic acid esters, vinyl esters, styrenes and olefins.

The content in the latex polymer of the monomer having a solubility in water at 25° C. of 0.000 to 0.025% by weight is preferably not less than 10 mol %, and more preferably not less than 50 mol %.

When the polymer latex used in the invention is obtained by polymerization, the surfactants used on the polymerization may be any of anionic surfactants, nonionic surfactants, cationic surfactants and amphoteric surfactants, and are preferably anionic and/or nonionic surfactants. As the anionic surfactants and/or nonionic surfactants, various compounds known to those skilled in the art may be used, but particularly, anionic surfactants are preferred.

The water-soluble polymer used on the polymerization includes a synthetic or natural water-soluble polymer. Either water-soluble polymer can be preferably used in the polymerization. The synthetic or natural water-soluble polymer has in its chamical structure a nonionic group, an anionic group, a cationic group, both nonionic group and anionic group, both nonionic group and cationic group, both anionic group and cationic group. The anionic group includes a carboxyl group or a salt thereof, a phosphate group or a salt thereof or a sulfonic acid group or a salt thereof. The cationic group includes a quaternary ammonium group or an tertiary amino group. Of the above water-soluble polymers is preferable a polymer having an anionic group or a polymer having both anionic group and nonionic group.

The water soluble polymer in the invention is one having a solubility of not less than 0.05 g, and preferably not less than 0.1 g in 100 g of water at 20° C.

Examples of the natural water-soluble polymer include those described in details in "Collective Technological Data of Water-soluble Polymers and Water-disperse Resins" (Keiei Kaihatsu Center), and preferably lignin, starch, pullulan, cellulose, dextran, dextrin, glycogen, alginic acid, gelatin, collagen, guar gum, gum arabic, laminarin, lichenin, nigellone and derivatives thereof. As derivatives of the natural water-soluble polymers there may be preferably used those sulfonated, carboxylated, phosphated, sulfoalkylated, carboxyalkylated or alkyl-phosphated and salts thereof, and more preferably glucose, gelatin, dextrin, cellulose and derivatives thereof. Examples of the synthetic water-soluble polymer include polyvinyl alcohol, polyacrylic acid, polyacryl amide and derivatives thereof.

The glass transition temperature Tg of a polymer constituting the polymer latex of the invention is preferably not higher than 60° C., and more preferably not higher than 40° C.

The Tg of many latex polymers used in the invention derived from ethylenically unsaturated monomers are described in Brandrup et al., the "Polymer Handbook", pp. III-139 through III-179 (1966) (Wiley & Sons).

The Tg of a copolymer is expressed by the following Formula:

$$Tg\ (\text{copolymer})=v_1Tg_1+v_2Tg_2+\ldots+vWTgW$$

wherein $v_1$, $v_2$ . . . vW each represent the content by weight of each monomer in the copolymer; and $Tg_1$, $Tg_2$ . . . TgW each represent the Tg of the homopolymer of each monomer in the copolymer.

The Tg value calculated according to the above formula has a precision of ±5° C.

Synthetic methods of the polymer latex used in the invention are described in detail in U.S. Pat. Nos. 2,852,386, 2,853,457, 3,411,911, 3,411,912 and 4,197,127, Belgian Patent Nos. 688,882, 691,360 and 712,823, JP E.P. No. 5331/1970, JP O.P.I. Nos. 18540/1985, 130217/1976, 137831/1983 and 50240/1980.

The polymer particles of the polymer latex in the invention have an average particle size of preferably 0.5 to 300 nm, and more preferably 30 to 250 nm.

The average particle size of the polymer particles of the polymer latex used in the invention may be measured according to the electron-microscopic photography method, the soap titration method, the light-scattering method or the centrifugal sedimentation method described in the "Polymer Latex Chemistry" (Kobunshi Ranko Kai, 1973). Of these methods the light-scattering method is preferable. As a mesuring instrument for the light-scattering method, a DLS700 is used.

The weight average molecular weight of the polymer of the polymer latex used in the invention, although not restricted, is preferably from 1,000 to 1,000,000, and more preferably 2,000 to 500,000.

The polymer latex of the invention may, either as it is or in the state of being dispersed in water, be incorporated into photographic component layers. The polymer latex content of the photographic component layer is 5 to 70% by weight of the binder of the layer in terms of polymer content. The polymer latex is added to any photographic component layer on the silver halide emulsion layer side regardless of whether it is a light-sensitive or non-light-sensitive hydrophilic colloid layer. The non-light-sensitive hydrophilic colloid layer herein refers to a layer other than the silver halide emulsion layer, which includes a protective layer, an intermediate layer or an anti-halation layer. The polymer latex is preferably added to a light-sensitive layer, a silver halide emulsion layer.

The polymer latex of the invention includes also functional polymers such as polymer couplers or polymer UV absorbing agents which are added in the form of latex.

The following are synthetic examples of the polymer latex of the invention, but the invention is not limited thereto.

SYNTHETIC METHOD OF POLYMER LATEXES

Synthetic Example 1 (Synthesis of Lx-1)

Three hundred and fifty milliliters of water were put in a 1,000 ml four-neck flask equipped with a stirrer, a thermometer, a dropping funnel, a nitrogen conduction pipe and a reflux condenser while introducing a nitrogen gas, and was heated to 80° C., and to this were added 4.5g of surfactant Sf-1 as a dispersing agent and 0.45 g of ammonium persulfate as a polymerization initiator. Thereafter, 90 g of ethylhexyl acrylate were added dropwise through the dropping funnel in about an hour. After completion of the dropwise addition, the reaction was still continued for another 5 hours, and then any unreacted monomer was removed by steam distillation. Afterward, the resulting mixture was cooled and was adjusted to a pH of 6 with ammonia water to obtain the polymer latex, Lx-1. The average particle size of the polymer in the polymer latex was 150 nm.

Synthetic Example 2: Synthesis of Lx-2

Three hundred and fifty milliliters of water were put in a 1,000 ml four-neck flask equipped with a stirrer, a thermometer, a dropping funnel, a nitrogen conduction tube and a reflux condenser while introducing a nitrogen gas thereinto and was heated until the temperature reached 80° C., and to this were added 4.5 g of P-3 in the invention as a dispersing agent and 0.45 g of ammonium persulfate as a polymerization initiator. Thereafter, 90 g of ethylhexyl acrylate were added dropwise through the dropping funnel in about an hour. After completion of the dropwise addition, the reaction was still continued for another 4 hours, and then the unreacted monomer was removed by steam distillation. Afterward, the resulting mixture was cooled and was adjusted to be a pH of 6 with ammonia water to obtain the polymer latex, Lx-2. The average particle size of the polymer in the polymer latex was 200 nm.

Synthetic Example 3: Synthesis of Lx-10

Two hundred milliliters of dioxane were put in a 500 ml three-neck flask while introducing a nitrogen gas thereinto, and later to this were added 15 g of isononyl acrylate, 35 g of cyclohexyl acrylate and 1.2 g of dimethyl azobisisobutyrate as a polymerization initiator. The resulting mixture was reacted for 6 hours at 60° C. After completion of the reaction, the reaction mixture was poured in 3 liters of distilled water with vigorous stirring, whereby white crystals were obtained.

The white crystals were filtered out, dried, and then dissolved in 100 ml of ethyl acetate. This solution was poured with vigorous stirring into 500 ml of distilled water containing 2 g of Sf-2, and then the ethyl acetate was removed to obtain the polymer latex, Lx-10. The average particle size of the polymer in the polymer latex was 180 nm.

Synthestic Example 4: Synthesis of Comparative Latex L

To a solution obtained by dissolving 0.25 kg of KMDS (sodium dextran sulfate, produced by Meito Ind. Co.) and 0.05 kg of ammonium persulfate in 40 liters of water was added spending an hour a mixture of 4.51 kg of n-butyl acrylate, 5.49 kg of styrene and 0.1 kg of acrylic acid, with stirring at 81° C. under a nitrogen atmospheric condition. Then, 0.005 kg of ammonium persulfate was added and stirred further for 1.5 hours. Thereafter, the reaction mixture was cooled and adjusted to be a pH of 6 with ammonia water to obtain latex.

The above obtained latex was filtered out by using a GF/D filter manufactured by Whotman Co., and water was added to make 50.5 kg to obtain a monodisperse latex (L). The average particle size of the polymer in the latex was 250 nm.

Exemplified polymers of the polymer latex of the invention and the surfactant used on its polymerization are listed below, wherein each suffixed number represents the content (mol %) of each monomer unit, and the water solubility of each monomer is shown underneath the structural formula thereof.
Surfactant
Lx-1
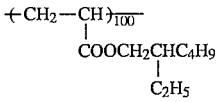
(0.010)
Sf-1
Lx-2
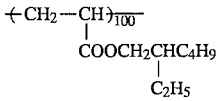
(0.010)
P-3
Lx-3
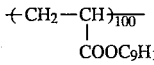
(0.004)
P-2
Lx-4
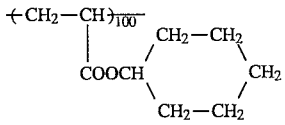
(0.010)
P-1
Lx-5
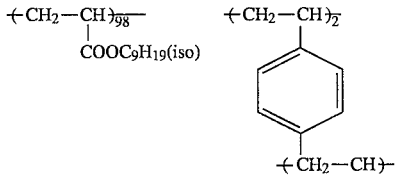
(0.004)
P-3
Lx-6
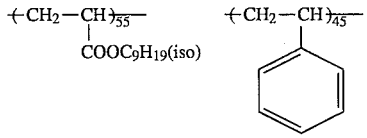
(0.004) (0.030)
Sf-2
Lx-7
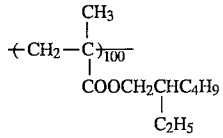
(0.010)
Dextransulfate
Lx-8
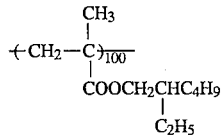
(0.010)
P-4

-continued
Lx-10
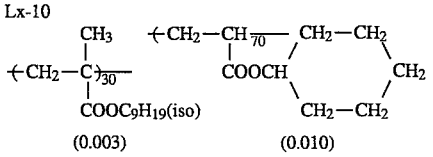
(0.003) (0.010) Sf-2
Lx-11
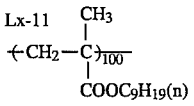
(0.003) Sf-1
Lx-12
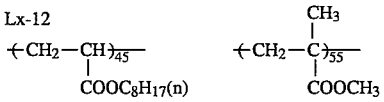
(0.010) (1.720) Sf-3
Lx-13
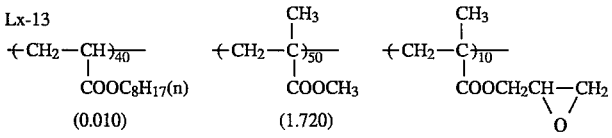
(0.010) (1.720) (2.500) Sf-4
Lx-14
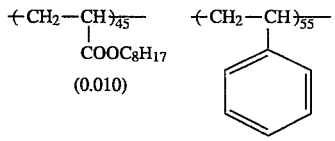
(0.010) (0.030) Sf-3
Lx-15
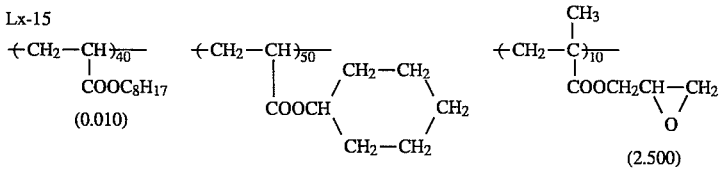
(0.010) (0.010) (2.500) P-2
Lx-16
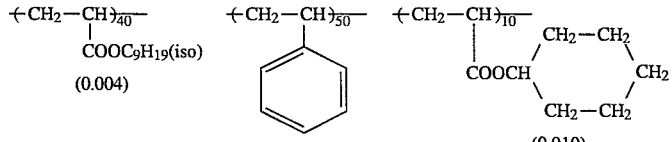
(0.004) (0.030) (0.010) P-3
Lx-17
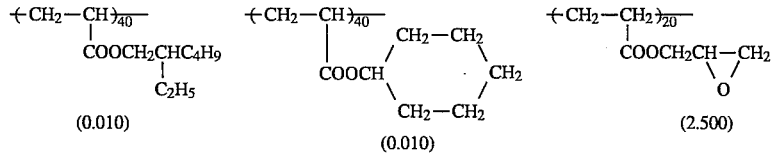
(0.010) (0.010) (2.500) Sf-1

-continued
Lx-18
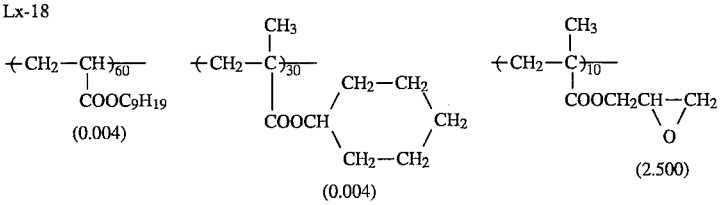
P-3
Lx-19
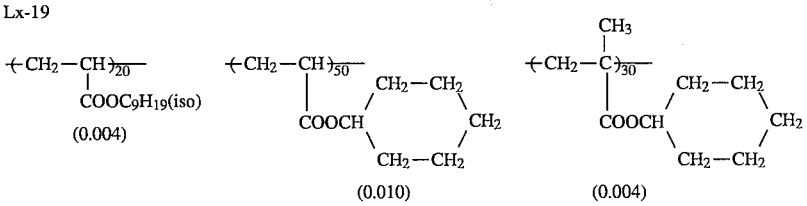
P-10
Sf-14
Lx-20
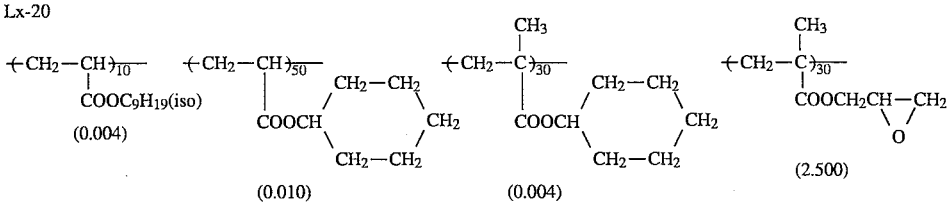
P-2
Sf-3
Lx-21
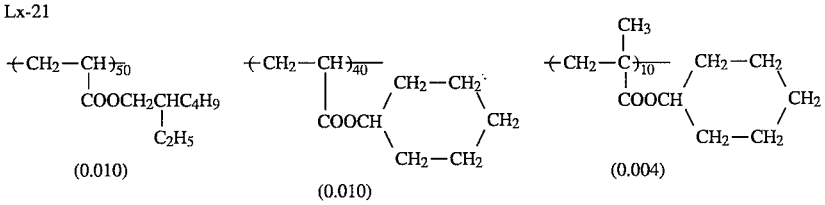
Sf-3
Sf-1
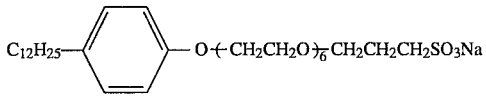
Sf-2
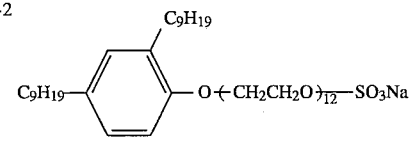
Sf-3
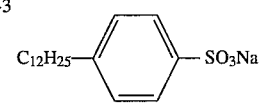
Sf-4
$C_{12}H_{25}OSO_3Na$
P1
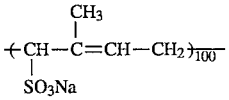
Mw = 5000

-continued

P2

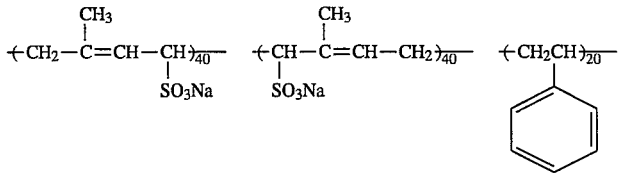

Mw = 40000

P-3

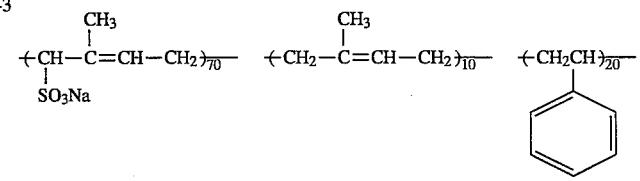

Mw = 40000

P-4

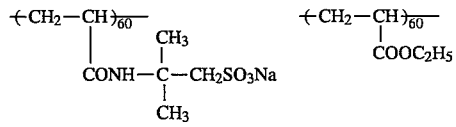

150,000

In the invention, the polymer latex content of the photographic component layer is preferably 10 to 300% by weight, and more preferably 30 to 200% by weight based on the total gelatin content of the layer on the silver halide emulsion layer side in terms of polymer content.

The surface pH on a side having a silver halide emulsion layer of the silver halide photographic light-sensitive material of the present invention is 6.0 or less, and preferably 2.5 to 5.8.

In order to regulate aforesaid pH, an acid or alkali is used. Preferably, by the use of sulfuric acid, nitric acid or hydrochloric acid, pH is reduced.

In the present invention, the surface pH of a light-sensitive material is measured as follows; under the environmental conditions of 25° C. and 90% RH, a sample of the light sensitive material is left for 30 minutes, then a pH meter is brought into contact with the layer surface of the sample, and the value shown after 3 minutes is defined to be a pH value of the surface. As the pH meter PH METER (HM-30V) produced by TOA DENPA KOGYO CO. Ltd. was used.

A silver halide emulsion usable in the silver halide photographic light-sensitive material of the present invention may include silver bromide, silver bromoiodide or silver bromoiodochloride containing a small amount of silver chloride. The halide grains may be of any crystal type, as far as they are of a configuration of the present invention.

The emulsion used in the silver halide photographic light-sensitive material of the present invention can be produced by a conventional method.

The grain size distribution of the silver halide may either be mono-dispersed emulsion having narrow distribution or poly-dispersed one having wide distribution.

These emulsions may be either a surface latent image type which forms latent images on the surface of a grain, or an inner-latent image type wherein latent images are formed inside the grains or a type forming latent images on the surface and inside of the grain as well.

For these emulsions, cadmium salts, lead salts, zinc salts, tarrium salts, iridium salts or their complex salts, rhodium salts or their complex salts, iron salts or their complex salts may be used during physical ripening or at the stage of grain preparation.

For the emulsion used in the silver halide photographic light-sensitive material of the present invention, various additives for photographic use can be used in a step before or after physical ripening or chemical ripening. As compounds used in these steps, various compounds described in the above-mentioned (RD)Nos. 17643, 18716 and 308119 can be used. Locations where the compounds are described in these three (RD) are shown below:

| | RD-17643 | | | RD-308119 | |
|---|---|---|---|---|---|
| Additive | Page | Classification | RD-18716 Page | Page | Classification |
| Chemical Sensitizer | 23 | III | 648 upper right | 996 | III |
| Sensitizing Dye | 23 | IV | 648–649 | 996-8 | IV |
| Desensitizing Dye | 23 | IV | | 998 | B |
| Dye | 25–26 | VIII | 649–650 | 1003 | VIII |
| Development Accelerating Agent | 29 | XXI | 648 upper right | | |
| Stabilizing Agent | 24 | IV | 649 upper right | 1006-7 | VI |
| Brightening Agent | 24 | V | | 998 | V |
| Hardener | 26 | X | 651 left | 1004-5 | X |
| Surfactant | 26–27 | XI | 650 right | 1005-6 | XI |
| Plasticizer | 27 | XII | 650 right | 1006 | XII |
| Slipping Agent | 27 | XII | | | |
| Matting Agent | 28 | XVI | 650 right | 1008-9 | XVI |
| Binder | 26 | XXII | | 1003-4 | IX |

-continued

| Additive | RD-17643 Page | RD-17643 Classification | RD-18716 Page | RD-308119 Page | RD-308119 Classification |
|---|---|---|---|---|---|
| Support | 28 | XVII | | 1009 | XVII |

A support used in the silver halide photographic light-sensitive material of the present invention includes those described in (RD) above. A suitable support includes a plastic film. With regard to the surface of the support, a subbing layer may be provided or corona discharge and UV ray irradiation may be given for enhancing adhesivity of the coating layer.

In the invention the processing time of the light-sensitive material of the invention is 10 to less than 45 seconds, and more preferably 10 to 30 seconds. The processing time referred to herein is the total time necessary to process an exposed silver halide photographic light-sensitive material, and concretely, the time necessary to carry out the steps comprising developing, fixing, washing and drying the material.

The processing agent used in each processing step is a conventional one used in the art.

As the developing agent of a black and white developer the following can be used singly or in combination: dihydroxy benzenes like hydroquinone, 3-pyrazolidone like 1-phenyl-3-pyrazolidone, and aminophenols like N-methyl-p-aminophenol. Besides the above compounds the developer optionally contains various preservatives, alkali agents, pH buffering agents, anti-foggants, a hardener, a development accelerator, a surfactant, an anti-foaming agent, a toning agent, a water softening agent, an auxiliary solubility agent or a viscosity increasing agent.

As a fixing agent in the fixer a thiosulfate or a thiocyanate is used. The fixer may contain a soluble aluminum salt such as aluminium sulfate or potash alum for a hardener. Beside the above, the fixer may contain a preservative, a pH buffering agent or a water softening agent.

EXAMPLES

Hereunder, examples of the present invention will be explained. However, the present invention is not limited thereto.

Example 1

Preparation of Emulsions A through C

Preparation of Seed Emulsion

While controlling at 60° C., pAg of 8 and pH of 2.0, a mono-dispersed cubic crystal silver bromoiodide grains having an average grain size of 0.3 μm wherein 2 mol % of silver iodide is contained was prepared by the use of a double jet method. The resulting solution was subjected to desalting using an aqueous Demol N solution produced by Kao Atlas Co. and an aqueous magnesium solution at 40° C. Following this, an aqueous gelatin solution was added for re-dispersion. Thus, a seed emulsion was obtained.

Growth From the Seed Emulsion

Using the above-mentioned seed emulsion, grains were grown in the following manner. At first, the seed emulsion was dispersed in an aqueous gelatin solution kept at 40° C. Then, pH was adjusted to 9.7 with an aqueous ammonia solution and acetic acid.

To this solution, an aqueous ammonia silver nitrate ion solution, an aqueous potassium bromide and an aqueous potassium iodide solution were added by a double jet method. During the addition, pAg was controlled at 7.3 and pH was controlled at 9.7 so that a layer having a silver iodide content of 35 mol % was formed. Next, an aqueous ammonia silver nitrate solution and an aqueous potassium bromide solution were added by means of a double jet method. Up to 95% of the targeted grain size, pH was continuously changed from 9.0 to 8.0 while pAg was kept at 9.0.

After that, pAg was regulated to 11.0, and the grains were grown to the targeted grain size while keeping pH at 8.0. Then, pH was reduced to 6.0 with acetic acid, and silver potential was controlled to be +25 mV with an aqueous potassium solution. Next, as a spectral sensitizing dye, 300 mg per mol of silver halide of an anhydride of 5,5'-dichloro-9-ethyl-3,3'-di-(3-sulfopropyl)-oxacarbocyanine sodium salt (dye A) and 15 mg per mol of silver halide of an anhydride of 5,5-di-(buthoxycarbonyl)-1,1'-diethyl-3,3'-di-(4-sulfobutyl)benzimidazolocarbocyanine sodium salt (dye B) were added to the solution.

Next, in order to remove excessive salts, the resulting solution was subjected to precipitation desalting by the use of an aqueous Demol N solution and an aqueous magnesium sulfate solution as decribed above. To the resulting solution, an aqueous gelatin solution containing 92.2 g of osein gelatin was added and the resulting solution was stirred for re-dispersion.

By the use of this method, there were prepared tetradecahedral mono-dispersed silver bromoiodide emulsions (A), (B) and (C) having respectively an average silver iodide content of 2.0 mol % wherein the top of the grains is roundish. The average grain sizes of emulsions (A), (B) and (C) are 0.40 μm, 0.65 μm and 1.00 μm, respectively and the variation coefficients (δ/r) of emulsions (A), (B) and (C) are 0.17, 0.16 and 0.16, respectively.

Preparation of Emulsions D through G

Preparation of a Spheric Seed Emulsion

By a method described in Japanese Patent O.P.I. Publication No. 6643/1986, a mono-dispersed spheric seed emulsion was prepared.

| | | |
|---|---|---|
| A1 | Osein gelatin | 150 g |
| | Potassium bromide | 53.1 g |
| | Potassium iodide | 24 g |
| | Water was added to make 7.2 l in total. | |
| B1 | Silver nitrate | 15000 g |
| | Water was added to make 6 l in total. | |
| C1 | Potassium bromide | 1327 g |
| | 1-phenyl-5-mercaptotetrazole (dissolved in methanol) | 1.2 g |
| | Water was added to make 3 l in total. | |
| D1 | Aqueous ammonia (28%) | 705 ml |

To Solution A1 stirred vigorously at 40° C., Solutions B1 and C1 were added in 30 seconds by a double jet method so that nuclei were produced. In this occasion, pBr was 1.09 to 1.15.

After 1 minute and 30 seconds, Solution D1 was added thereto in 20 seconds, and the resulting solution was subjected to ripening for 5 minutes. The concentration of KBr in ripening was 0.071 mol/l, and that of ammonia was 0.63 mol/l in ripening.

Immediately after pH was regulated to 6.0, the solution was subjected to desalting and washing. When this seed emulsion was observed using an electron microscope, this emulsion proved to be a mono-dispersed spherical seed emulsion having an average grain size of 0.26 μm and the distribution width of 18%.

Preparation of Grown Emulsion

The resulting spherical seed emulsion of 0.14 mol per mol of silver of the grown emulsion was dissolved and dispersed at 65° C. in an aqueous gelatin solution containing sodium polypropyreneoxy-polyethyleneoxy-disuccinate. Following this, $1\times10^{-5}$ mol of dimethylaminborane was added thereto per mol of silver of the silver halide emulsion prepared finally. Subsequently, to the resulting solution, a silver nitrate solution and a halide solution of potassium bromide and potassium iodide were added in 43 minutes by a double jet method while keeping at pH 2.0, at pAg 8.0 and at 65° C. to obtain an average silver iodide content of 0.50 mol %.

In the meanwhile, silver potential was controlled at +25 mV by the use of an aqueous potassium bromide solution.

After addition, the above-mentioned dye A and dye B as spectral sensitizing dyes were added in an amount of 300 mg per mol of silver halide and 15 mg per mol of silver halide, respectively.

Next, in order to remove excessive salts, the resulting solution was subjected to precipitation desalting by the use of an aqueous Demol N solution and an aqueous magnesium sulfate solution in the same manner as above. To the resulting solution, an aqueous gelatin solution containing 92.2 g of osein gelatin was added, stirred and re-dispersed. Thus, emulsion D containing a tabular silver bromoiodide whose average grain size is 1.22 μm, average thickness is 0.29 μm and aspect ratio is 4.2 was obtained. By regulating pAg and pH in the same method as above, emulsions E through G whose aspect ratios are 2.5, 7.2 and 12 were prepared.

To each of emulsions A through G obtained, the above-mentioned spectral sensitizing dyes A and B was added at 55° C. in quantity of 300 mg and 15 mg per mol of silver halide, respectively.

After 10 minutes, appropriate amount of chloroauric acid, sodium thiosulfate and ammonium thiocyanate were added for chemical ripening. Fifteen minutes before the end of ripening, silver iodide fine grains (the average grain size is 0.05 μm) containing 0.08 mmol of potassium iodide per mol of silver halide were added. Following this, $3\times10^{-2}$ mol of 4-hydroxy-6-methyl-1,3,3a,7-tetrazaindene per mol of silver halide was added. The resulting solution was dispersed in an aqueous solution containing 70 g of gelatin.

Each emulsion already subjected to chemical sensitization was mixed in a ratio of A:B:C=1:6:3 and A:D:C=1:6:3. Thus, emulsions H and I were prepared.

To the resulting emulsion, additives mentioned later were added so that a coating solution for emulsion layer was prepared. Concurrently with this, a coating solution for the protective layer was also prepared. For coating, the above-mentioned support was used. The emulsion and protective layer coating solution were coated on both sides of the support simultaneously at a speed of 80 m per minute using 2 units of slide hopper type coaters to give a silver content of 1.9 g/m$^2$ and the amount of gelatin shown in Table 1 on one side of the support and dried for 2 minutes and 20 seconds. Thus, a sample film was obtained. The amount of hardener was regulated so that the swelling ratio would be 190%.

The pH of the film surface was regulated to give the pH value described in Table 1 by adding nitric acid to the coating solution of the protective layer. The polymer latex was added to the emulsion or the coating solution of the protective layer to give the amount of polymer latex shown in Table 1.

The additives used for the emulsions are as follows. The added amount is represented by a weight amount per mol of silver halide.

| | |
|---|---|
| 1,1-dimethylol-1-bromo-1-nitromethane | 70 mg |
| t-butyl-cathecol | 400 mg |
| Polyvinyl pyrrolidone (molecular weight 10,000) | 1.0 g |
| Styrene-maleic acid anhydride copolymer | 2.5 g |
| Nitrophenyl-triphenyl phosphonium chloride | 50 mg |
| Ammonium 1,3-dihydroxybenzene-4-sulfonic acid | 2 g |
| Sodium 2-mercaptobenzimidazole-5-sulfonic acid | 1.5 g |
| 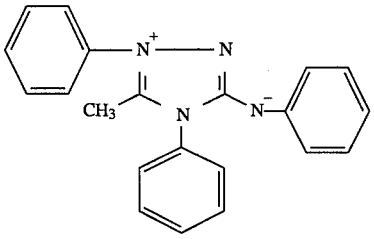 | 150 mg |
| 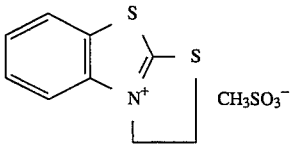 | 30 mg |
| $C_4H_9OCH_2CH(OH)CH_2N(CH_2COOH)_2$ | 1 g |
| 1-phenyl-5-mercaptotetrazole | 15 mg |
| Protective layer solution | |

Next, the following was prepared as a coating solution for the protective layer. The amount of additives is represented in terms of amount per liter of coating solution.

| | |
|---|---|
| Gelatin | amount necessary to give the amount shown in Table 1 |
| Sodium-i-amyl-n-decylsulfosuccinate | 1 g |
| Polymethyl methacrylate (matting agent having an average grain size of 3.5 μm) | 1.1 g |
| Silicon dioxide grain (matting agent having an average grain size of 1.2 μm) | 0.5 g |
| Rudox AM (produced by Du Pont) (colloid silica) | 30 g |
| $(CH_2{=}CHSO_2CH_2)_2O$ (hardener) | appropriate |
| $C_4F_9SO_3K$ | 2 mg |
| $C_{12}H_{25}CONH(CH_2CH_2O)_5H$ | 2.0 g |
| 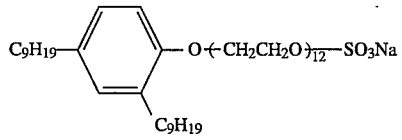 | 12 mg |

-continued

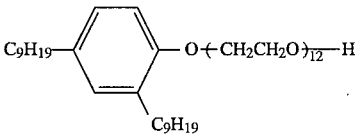

2 mg $NaO_3S-CH(CH_2COOCH_2(C_2F_4)_3H)COOCH_2(C_2F_4)_3H$ 5 mg

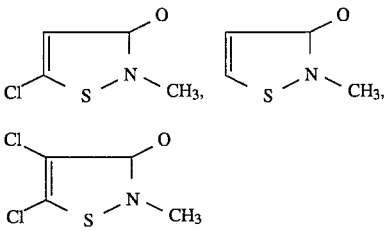

(50:46:4 = mole ratio)

0.73 mg $F_{19}C_9O(CH_2CH_2O)_{10}CH_2CH_2OH$ 3 mg

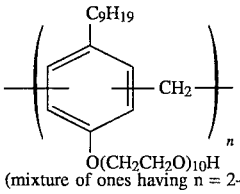

(mixture of ones having n = 2–5)

15 mg

Sensitometry

Using standard light B described in "Data book on illumination/New edition" (1st edition and 2nd edition), on page 39 as a light source, a sample was subjected to the so-called white exposure wherein the sample was exposed to white light with non-filter at an exposure time of 0.1 second and 3.2 CMS. Sensitivity is calculated from the inverse of the exposure amount necessary to give a density 1.0 higher than the fog density, and it is indicated in terms of relative sensitivity when that of Sample No.1 is defined to be 100.

Processing was conducted through steps a, b or c by the use of the following developing solution and fixer in an automatic processor SRX-503 (produced by KONICA CORPORATION) which was modified.

| | Processing temperature (°C.) | Processing time (second) | | | Amount of replenishing |
|---|---|---|---|---|---|
| Processing step | | a | b | c | |
| Insertion | — | 1.2 | 0.8 | 0.5 | |
| Development + cross over | 35 | 14.6 | 9.7 | 6.5 | 270 ml/m² |
| Fixing + cross over | 33 | 8.2 | 5.5 | 3.7 | 430 ml/m² |
| Washing + cross over | 18 | 7.2 | 4.8 | 3.2 | 7.01 l/min |
| Squezing | 42 | 5.7 | 3.8 | 2.5 | |
| Drying | 48 | 8.1 | 5.4 | 3.6 | |
| Total | | 45.0 | 30.0 | 20.0 | |

<Formula of developer>

| Part-A (for 15 l in finishing) | |
|---|---|
| Potassium hydroxide | 470 g |
| Potassium sulfite (50% solution) | 3000 g |
| Sodiumm hydrogencarbonate | 150 g |
| Pentasodium diethylenetriamine pentaacetate | 45 g |
| 5-methyl benzotriazole | 2.0 g |
| 1-phenyl-5-mercapto tetrazole | 0.2 g |
| Hydroquinone | 390 g |
| Water was added to make 500 ml in total. | |
| Part-B (for 15 l in finishing) | |
| Glacial acetic acid | 265 g |
| Triethylene glycol | 200 g |
| 1-phenyl-3-pyrazolidone | 27 g |
| 5-nitroindazole | 0.45 g |
| N-acetyl-DL-penycillamine | 0.15 g |
| Potassium bromide | 60 g |
| 5-methylbenzotriazole | 0.3 g |
| Water was added to make 500 ml in total. | |

Part-A and Part-B, above, were mixed and water was added to make 15 liters. Thus, the developing solution was prepared.

<Formula of fixer>

| Part-A (for 19 l in finishing) | |
|---|---|
| Ammonium thiosulfate (70 wt/vol %) | 4000 g |
| Sodium sulfite | 175 g |
| Sodium acetate trihydrate | 400 g |
| Sodium citrate | 50 g |
| Gluconic acid | 38 g |
| Boric acid | 30 g |
| Glacial acetic acid | 140 g |
| Water was added to make 5 l. | |
| Part-B (19 l in finishing) | |
| Anhydrous aluminium sulfate | 65 g |
| Surfuric acid (50 wt %) | 105 g |
| Water was added to make 800 ml. | |

Part-A and Part-B, above, were mixed and water was added to make 19 liters. Thus, the fixer was prepared.

Roller Mark

A sample film was exposed to give a density of 1.0, and was processed in the same manner as above. The resulting sample was observed for roller mark.

Evaluation criteria

A: No pressure spot is observed.

B: Faint spots are observed at a edge portion of the film when observed carefully. However, there is no practical problem.

C: Faint spots are observed at a center portion of the film. However, there is no practical problem.

D: Clear spots are observed at a film edge portion of the film. This is a problem practically.

E: Clear spots are observed at a film edge and center portion of the film. This can not be used practically.

Color Stain Property

An unexposed sample film was processed in the same manner as above. The resulting sample was observed for color stain.

Evaluation creteria

A: No color stain is observed.

B: Film edge portion is slightly reddish when observed carefully. However, there is no practical problem.

C: Film edge portion is reddish in a streak form when observed carefully. However, there is no practical problem.

D: Center portion is reddish in a streak form. This is a problem practically.

E: Clear reddish unevenness occurred at the center portion of the film. This can not be used practically.

The results are shown in Table 1.

As is apparent from Table 1, inventive samples exhibit improved results in sensitivity, roller marks and color stain as compared to comparative samples, when rapidly processed in an automatic processor.

TABLE 1

| Sample No. | Emulsion No. | Amount of gelatin in an emulsion layer (g/m²) | Amount of gelatin in a protective layer (g/m²) | Latex polymer: Latex used | Latex polymer: Position of addition | Latex polymer: Amount of adding (g/m²) | pH of the surface of the sample | Processing step | Sensitivity | Roller mark | Color stain | Note |
|---|---|---|---|---|---|---|---|---|---|---|---|---|
| 1 | H | 2.00 | 1.10 | L | Emulsion layer | 0.40 | 5.90 | a | 100 | C | C | Comp. |
| 2 | H | 2.00 | 1.10 | L | Emulsion layer | 0.40 | 5.90 | b | 90 | C | D | Comp |
| 3 | H | 2.00 | 1.10 | LX-1 | Emulsion layer | 0.40 | 5.90 | a | 100 | C | B | Comp. |
| 4 | H | 2.00 | 1.10 | LX-1 | Emulsion layer | 0.40 | 5.90 | b | 100 | B | B | Inv. |
| 5 | H | 2.00 | 1.10 | LX-1 | Emulsion layer | 0.40 | 5.70 | b | 100 | A | A | Inv. |
| 6 | H | 2.00 | 1.10 | LX-1 | Emulsion layer | 0.40 | 6.10 | b | 95 | C | C | Comp. |
| 7 | I | 2.00 | 1.10 | LX-2 | Emulsion layer | 0,40 | 6.10 | b | 96 | C | C | Comp. |
| 8 | I | 2.00 | 1.10 | LX-2 | Emulsion layer | 0.40 | 5.90 | b | 104 | A | B | Inv. |
| 9 | I | 2.00 | 1.10 | LX-2 | Emulsion layer | 0.40 | 5.70 | b | 105 | A | A | Inv. |
| 10 | I | 2.00 | 1.10 | LX-2 | Emulsion layer | 0.40 | 5.50 | b | 102 | A | A | Inv. |
| 11 | I | 2.00 | 1.10 | LX-2 | Emulsion layer | 0.40 | 5.50 | a | 104 | C | B | Comp. |
| 12 | I | 2.00 | 1.10 | LX-2 | Protective layer | 0.40 | 5.70 | b | 104 | A | B | Inv. |
| 13 | I | 2.00 | 1.10 | LX-10 | Protective layer | 0.40 | 5.70 | b | 104 | A | B | Inv. |
| 14 | I | 2.00 | 0.60 | LX-10 | Protective layer | 1.00 | 5.70 | b | 104 | A | B | Inv. |
| 15 | I | 1.50 | 1.10 | LX-10 | Emulsion layer | 1.00 | 5.70 | b | 105 | A | A | Inv. |
| 16 | I | 1.00 | 0.80 | LX-10 | Emulsion layer | 1.00 | 5.70 | c | 102 | A | B | Inv. |
| 17 | I | 1.00 | 0.80 | LX-10 | Emulsion layer | 1.00 | 5.30 | c | 102 | A | A | Inv. |
| 18 | I | 1.00 | 0.80 | LX-10 | Emulsion layer | 1.00 | 5.00 | c | 102 | A | A | Inv. |
| 19 | I | 1.00 | 0.80 | LX-10 | Emulsion | 1.00 | 6.10 | c | 97 | C | B | Comp. |

What is claimed is:

1. A silver halide photographic light-sensitive material comprising a support having provided thereon, a photographic component layer comprising a silver halide emulsion, said photographic component layer comprising a polymer latex of a polymer containing, in its chemical structure, a unit derived from a monomer having a solubility in water at 25° C. of 0.000% to 0.025% by weight, said monomer being selected from the group consisting of hexyl acrylate, 2-ethylhexyl acrylate, octyl acrylate, tert-octyl acrylate, nonyl acrylate, iso-nonyl acrylate, cyclohexyl acrylate, n-stearyl acrylate, lauryl acrylate, tridecyl acrylate, hexyl methacrylate, 2-ethylhexyl methacrylate, octyl methacrylate, iso-octyl methacrylate, tert-octyl methacrylate, nonyl methacrylate, iso-nonyl methacrylate, cyclohexyl methacrylate, n-stearyl methacrylate, lauryl methacrylate, and tridecyl methacrylate, the pH of a surface on a silver halide emulsion layer side of said material being not more than 6.0.

2. The material of claim 1, wherein the solubility of said monomer is 0.000 to 0.015% by weight.

3. The material of claim 1, wherein the average particle size of the polymer of the polymer latex is 0.5 to 300 nm.

4. The material of claim 1, wherein the polymer latex is contained in the silver halide emulsion layer of the photographic component layer.

5. The material of claim 4, wherein the polymer content of the silver halide emulsion layer is 10 to 300 % by weight based on the total gelatin content of the photographic component layer.

6. The material of claim 1, wherein the polymer latex is contained in a layer other than the silver halide emulsion layer of the photographic component layer.

7. The material of claim 6, wherein the polymer content of the layer other than the silver halide emulsion layer is 10 to 300% by weight based on the total gelatin content of the of the photographic component layer.

8. The material of claim 1, wherein the pH is 2.5 to 5.8.

9. The material of claim 1, wherein the polymer latex is obtained by polymerization of said monomer in the presence of a water-soluble synthetic or natural polymer.

10. The material of claim 9, wherein the water-soluble synthetic or natural polymer contains in its chemical structure an anionic group.

11. The material of claim 9, wherein the water-soluble synthetic or natural polymer contains in its chemical structure an anionic group and a nonionic group.

* * * * *